US009302141B2

(12) United States Patent
Haley

(10) Patent No.: US 9,302,141 B2
(45) Date of Patent: Apr. 5, 2016

(54) VARIABLE WEIGHT TONING STRAP AND KIT

(71) Applicant: Stephen C. Haley, Boynton Beach, FL (US)

(72) Inventor: Stephen C. Haley, Boynton Beach, FL (US)

(73) Assignee: BETTER WAY INVENTIONS, LLC, Boynton Beach, FL (US)

( * ) Notice: Subject to any disclaimer, the term of this patent is extended or adjusted under 35 U.S.C. 154(b) by 0 days.

(21) Appl. No.: 13/793,473

(22) Filed: Mar. 11, 2013

(65) Prior Publication Data

US 2013/0237391 A1 Sep. 12, 2013

Related U.S. Application Data

(60) Provisional application No. 61/609,449, filed on Mar. 12, 2012.

(51) Int. Cl.

| | |
|---|---|
| ***A63B 21/065*** | (2006.01) |
| ***A63B 21/00*** | (2006.01) |
| ***A63B 21/06*** | (2006.01) |
| *A63B 71/00* | (2006.01) |
| *A63B 23/12* | (2006.01) |

(52) U.S. Cl.

CPC ..... *A63B 21/065* (2013.01); *A63B 21/0004* (2013.01); *A63B 21/00065* (2013.01); *A63B 21/4021* (2015.10); *A63B 23/1209* (2013.01); *A63B 71/0036* (2013.01)

(58) Field of Classification Search

CPC ..... A63B 2210/50; A63B 71/0036; A63B 21/065; A63B 21/1419; A63B 2053/0491; A63B 21/075; A63B 21/0036; A63B 2225/68; A63B 2225/687

USPC ..... 482/44, 50, 92–93, 105, 139, 910; 2/338; 206/315.1

See application file for complete search history.

(56) References Cited

U.S. PATENT DOCUMENTS

| | | | | | |
|---|---|---|---|---|---|
| 3,532,339 | A * | 10/1970 | Smith | A63B 21/065 | 482/105 |
| 4,384,714 | A * | 5/1983 | Kimura | 482/105 | |
| 4,830,154 | A * | 5/1989 | Gerch et al. | 190/103 | |
| 4,899,887 | A * | 2/1990 | Cachero | A63B 71/0036 | 190/1 |
| 4,997,183 | A * | 3/1991 | Winston | 482/105 | |
| 5,075,902 | A * | 12/1991 | McReynolds | A63B 21/065 | 2/227 |
| 5,076,575 | A * | 12/1991 | Eylander | 482/105 | |
| 5,127,891 | A * | 7/1992 | Winston | 482/50 | |
| 5,868,652 | A * | 2/1999 | Spletzer | 482/105 | |
| 6,039,677 | A * | 3/2000 | Spletzer | A63B 21/0605 | 2/22 |
| 6,113,521 | A * | 9/2000 | Winston | 482/105 | |
| 6,200,243 | B1 * | 3/2001 | Meranto | A63B 21/0602 | 150/150 |
| 6,671,887 | B1 * | 1/2004 | Eligan | A63B 21/065 | 2/228 |
| 7,895,675 | B2 * | 3/2011 | Curphey | 2/338 | |
| 8,550,243 | B2 * | 10/2013 | Moore | 206/315.1 | |
| 2003/0186789 | A1 * | 10/2003 | Cook | 482/105 | |
| 2004/0043875 | A1 * | 3/2004 | Lederfeind | 482/105 | |
| 2007/0049854 | A1 * | 3/2007 | Teimourian | 602/19 | |

(Continued)

*Primary Examiner* — Oren Ginsberg
*Assistant Examiner* — Joshua Lee

(57) ABSTRACT

A variable weight toning method, system and kit. An elongated flexible member adapted to be worn for example on the wrist or ankle of the user includes various sections that selectively receive weighted bars. The number of bars is increased over time to increase muscular toning. The system may include a storage unit in which the flexible member and various weighted bars may be stored. The method includes gradually increasing the number of weighted bars in the flexible member as muscle tone improves.

13 Claims, 5 Drawing Sheets

(56) References Cited

U.S. PATENT DOCUMENTS

2007/0099774 A1* 5/2007 Bruback ..... 482/105
2008/0023355 A1* 1/2008 Reynolds ..... 206/315.1
2008/0179214 A1* 7/2008 Hall ..... 206/579
2009/0253560 A1* 10/2009 Cook ..... A63B 21/065 482/105
2010/0187382 A1* 7/2010 Cook ..... A47G 25/0664 248/188.91

* cited by examiner

VARIABLE WEIGHT TONING STRAP AND KIT

CROSS-REFERENCE TO RELATED APPLICATION

This application claims priority to U.S. Provisional Patent Application No. 61/609,449, filed Mar. 12, 2012, the entirety of which is hereby incorporated by reference.

BACKGROUND

Obesity is a medical condition in which excess body fat has accumulated to the extent that it may have an adverse effect on health, leading to reduced life expectancy and/or increased health problems. Obesity increases the likelihood of various diseases, particularly heart disease, Type 2 diabetes, obstructive sleep apnea, certain types of cancer, and osteoarthritis. Obesity is most commonly caused by a combination of excessive food energy intake, lack of physical activity, and genetic susceptibility, although a few cases are caused primarily by genes, endocrine disorders, medications or psychiatric illness. Obesity is a leading preventable cause of death worldwide, with increasing prevalence in adults and children, and authorities view it as one of the most serious public health problems of the 21st century.

Dieting and physical exercise are the mainstays of treatment for obesity. Physical exercise is any bodily activity that enhances or maintains physical fitness and overall health and wellness. Physical exercise is performed for various reasons including strengthening muscles and the cardiovascular system, honing athletic skills, weight loss or maintenance, as well as for the purpose of enjoyment. Frequent and regular physical exercise boosts the immune system, and helps prevent the "diseases of affluence" such as heart disease, cardiovascular disease, Type 2 diabetes and obesity. Physical exercise also improves mental health, helps prevent depression, helps to promote or maintain positive self-esteem, and can even augment an individual's sex appeal or body image which have also been found to be linked with higher levels of self-esteem.

Strength training is the use of resistance to muscular contraction to build the strength, anaerobic endurance, and size of skeletal muscles. When properly performed, strength training can provide significant functional benefits and improvement in overall health and well-being, including increased bone, muscle, tendon and ligament strength and toughness, improved joint function, reduced potential for injury, increased bone density, a temporary increase in metabolism, improved, cardiac function, and elevated HDL (good) cholesterol. Training commonly uses the technique of progressively increasing the force output of the muscle through incremental increases of weight, elastic tension or other resistance, and uses a variety of exercises and types of equipment to target specific muscle groups.

Toning exercises are physical exercises that are used with the aim of developing a physique with a large emphasis on musculature. In this context, the term toned implies leanness in the body (low levels of body fat), noticeable muscle definition and shape, but not significant muscle size ("bulk"). Appearing "toned" is a common fitness goal, particularly associated with women.

In today's hectic society, many individuals have a difficult time sticking to an exercise regimen.

Previously, the use of wrist weights is a form of resistance training, generally a kind of weight training. In addition to the greater effect of gravity on the person, wrist weights add resistance during ballet movements, due to more force needed to overcome the inertia of heavier masses, as well as a greater momentum that needs deceleration at the end of the movement to avoid, injury. The method may increase muscle mass or enhance the loss of weight; however, there have been concerns about the safety of some uses of weights, such as wrist and ankle weights. Wrist and ankle weights have heretofore been provided in the form of small weights, attached to increase endurance when performed in long repetitive events, such as running, swimming, punching, kicking or jumping.

Most, if not all of the wrist weights are heavy enough to immediately add a good amount of stress on joints and tendons. Previously, wrist weights were geared for use during a specific exercise or workout. Wrist weights are not light enough or even meant to be used all day, every day.

SUMMARY

The present variable weight toning strap overcomes the problems described above, and other problems inherent in any exercise or toning program as well as the natural human reluctance to remain on any form of exercise or training program.

The present variable weight toning strap may be used, for example, on the wrist and may even appear to the observer as a bracelet or jewelry. As such, the user may be more prone to continue to wear and use the strap, without even realizing that the user is engaged in a continuous form of exercise, and observers may not even realize that the user is engaged in a muscle toning regimen.

Another benefit of the variable weight toning strap is, of course, that the amount of weight may be increased or decreased as desired. The benefit of reduced amount of weight is, of course, to reduce the risk of muscle strain and interference with daily activities. The benefit of increased amount of weight is, of course, to gradually increase the degree of muscle tone.

The toning strap has a plurality of preferably discrete receptacles for individual weights—weights may be added or removed as desired.

The variable weight toning strap and kit includes a storage area for the strap and for the plurality of weights such that weights not being used are maintained readily available within the storage area yet are not susceptible to loss or inadvertently being misplaced.

BRIEF DESCRIPTION OF THE DRAWINGS

Various objects, benefits and advantages of the variable weight toning strap and kit will be apparent upon reading the above and the following detailed description taken in conjunction with the drawings.

In the drawings, wherein like reference numerals identify corresponding parts.

DETAILED DESCRIPTION

Figure 1:
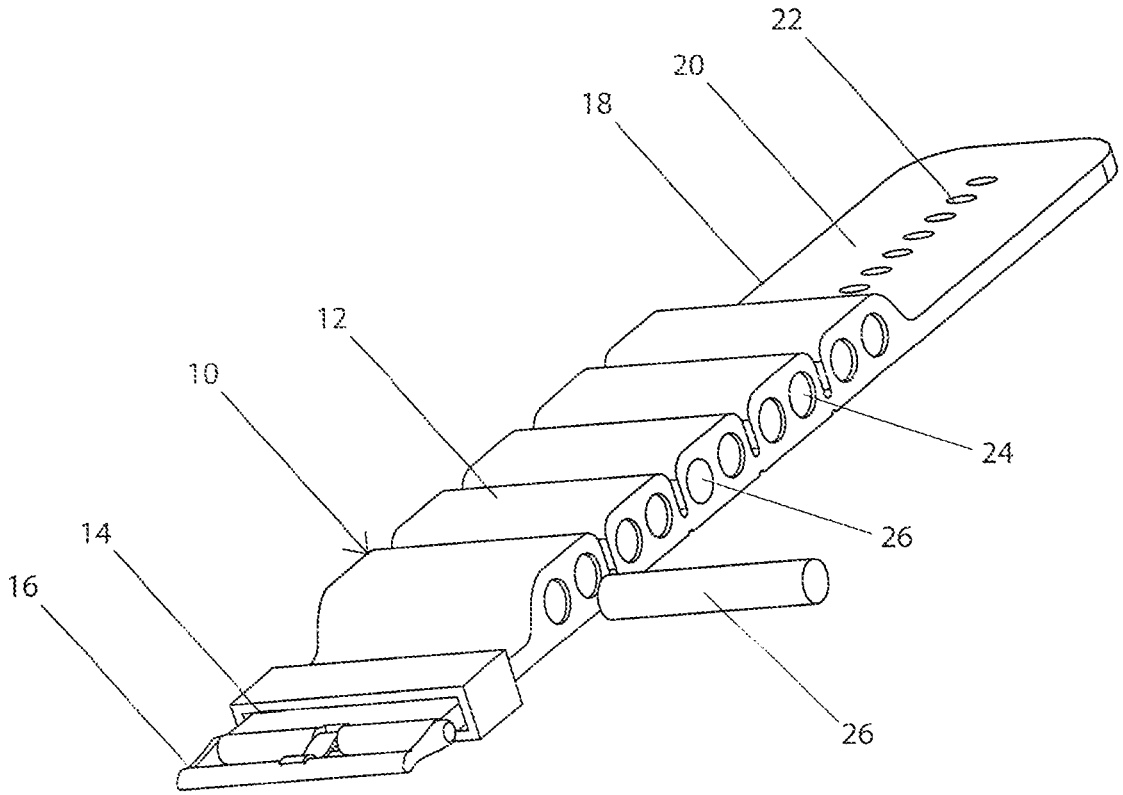
FIG. 1 is a perspective, partially exploded view of a variable weight toning strap with one weight bar in place and a second weight bar indicated as being either inserted into or removed from the strap.
Figure 2:
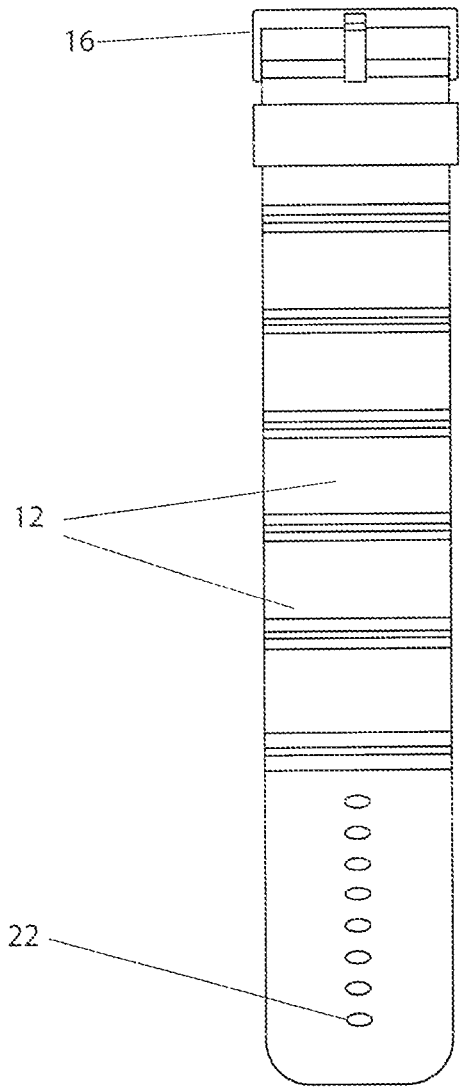
FIG. 2 is a plan view of the toning strap of FIG. 1.
Figure 3:
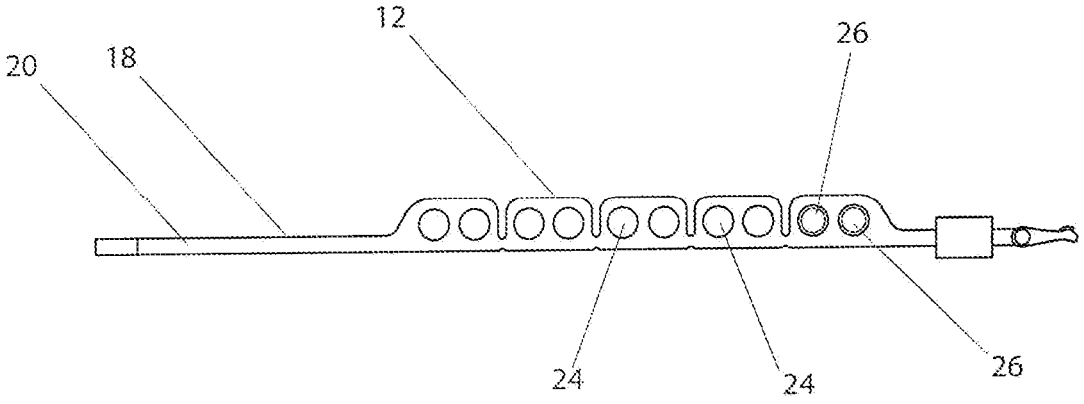
FIG. 3 is an elevation view of the toning strap of FIG. 1 with two weight bars in place.
Figure 4:
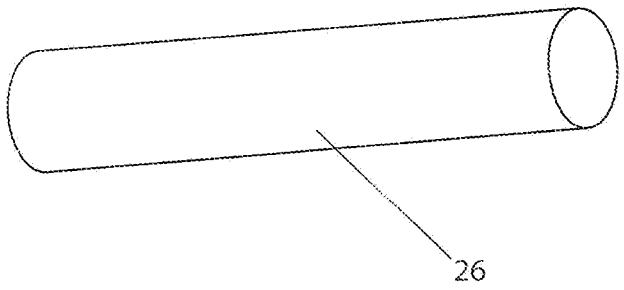
FIG. 4 is a perspective view of one form of an individual weight bar for the variable weight toning strap.

Referring to the drawings, a variable weight toning strap 10 is an elongated articulated member having a plurality of preferably elongated generally rectangular sections 12 preferably extending transversely of the length of the strap 10. Each section is preferably thicker (top to bottom) than the remainder of the strap 10 and essentially the same width as the strap 10. There are spaces or gaps transversely of the length of the strap between each section 12, thus the strap 10 may be flexed between adjacent sections. One end 14 of the strap may include a buckle 16 and the other end 18 of the strap may include a tab 20. The strap includes a series of apertures 22 such that when the tab is inserted into the buckle, a portion of the buckle extends into one of the apertures to secure the strap. Alternate forms of fastening the two ends of the strap such as hook and loop fasteners, as a non-limiting example, may be used.

The strap may be of appropriate length for the wrist, arm, ankle, leg, or any other part of the body of the user. At least two sections 12 should be provided although it is preferable to have sections generally along the full length of the strap since a larger number of sections tend to enhance the benefit from use of the variable weight toning strap. The apertures provide for adjustability of the effective length of the strap, i.e., the portion of the strap which could be in contact with the arm or leg of the wearer.

At least two of the sections 12 of the strap are provided with an aperture or socket 24 to receive a removable bar. It should be appreciated that it would be preferred that all sections 12 include such apertures as that tends to maximize the benefit of the variable weight toning strap.

As noted above, the strap sections 12 extend generally transversely of the length of the strap. The apertures would preferably extend in the elongated direction of the sections 12 and thus also extend transversely of the length of the strap. It should be appreciated, however, that the shape of the strap sections and of the apertures all may be varied.

A plurality of bars 26 are provided. The shape of each bar is generally the same as the length and shape of the aperture 24 such that the bar may be placed within the aperture. In the drawings, the bar is illustrated as being the shaped of a cylinder. The bars are preferably the same length as the aperture, for ease of insertion and removal, and the same cross-sectional shape as the apertures such that a bar is frictionally retained within an aperture. The bars and apertures are illustrated as being of circular cross-section however it should be understood and appreciated that the specific shapes may be varied.

Preferably, the strap is fabricated from a flexible material such as silicone or rubber. Other materials may be used regardless of whether naturally occurring, for example leather, or fabrics or synthetics. Metal and metal alloys may be used. Combinations of the above may be used.

The bars may be formed from a heavy metal such as bismuth. The bars need not be of the same weight and, in addition, some of the bars may be removable while other bars are non-removable.

To use the variable weight toning strap, a first bar 26 may be placed within a receptacle or aperture 24 and the strap fastened such as around the wrist or ankle of the user. Normal movements by the user of the strap, throughout the day while the strap is being worn, will enhance muscle tone. At irregular or regular intervals, as desired, such as daily or weekly, additional bars may be added. If a user reaches the point where all the bars are being used, and further muscle tone is desired, bars of a heavier weight may be used.

The straps may be used in pairs, such as one on each wrist or one on each ankle (or four straps, one on each extremity).

Figure 5:
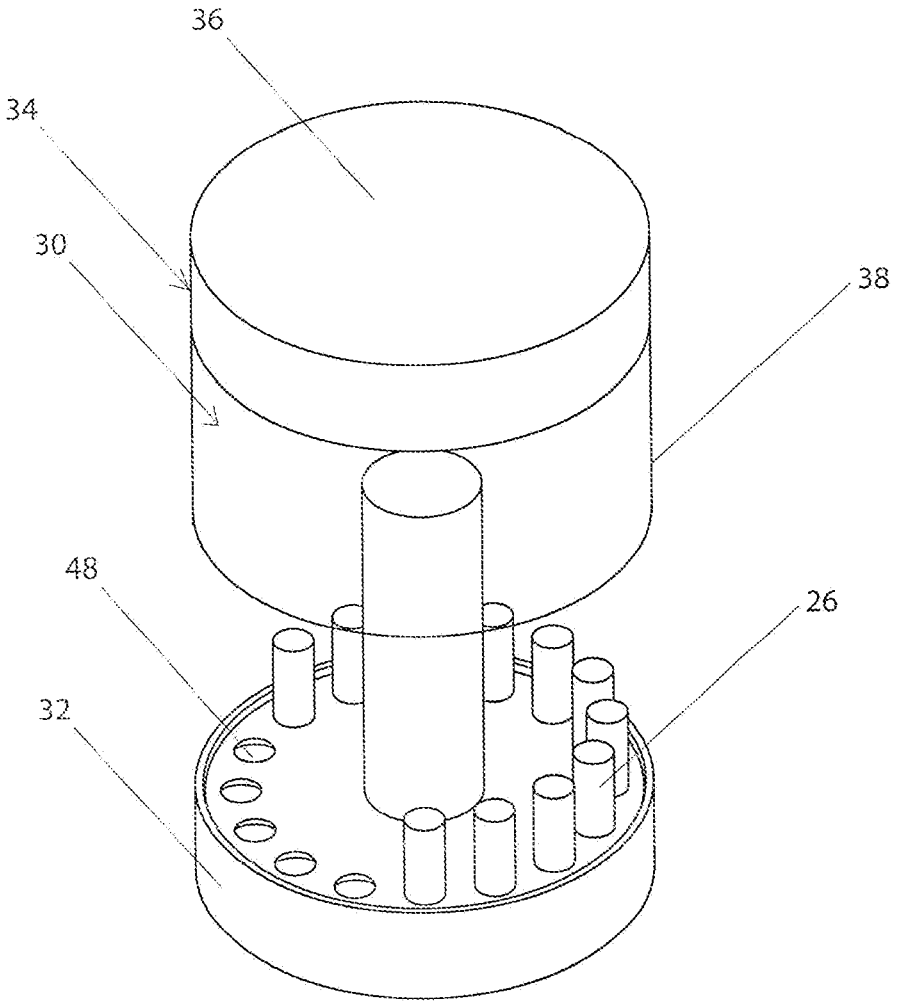
FIG. 5 is a partially exploded illustration of a variable weight toning strap storage unit.
Figure 6:
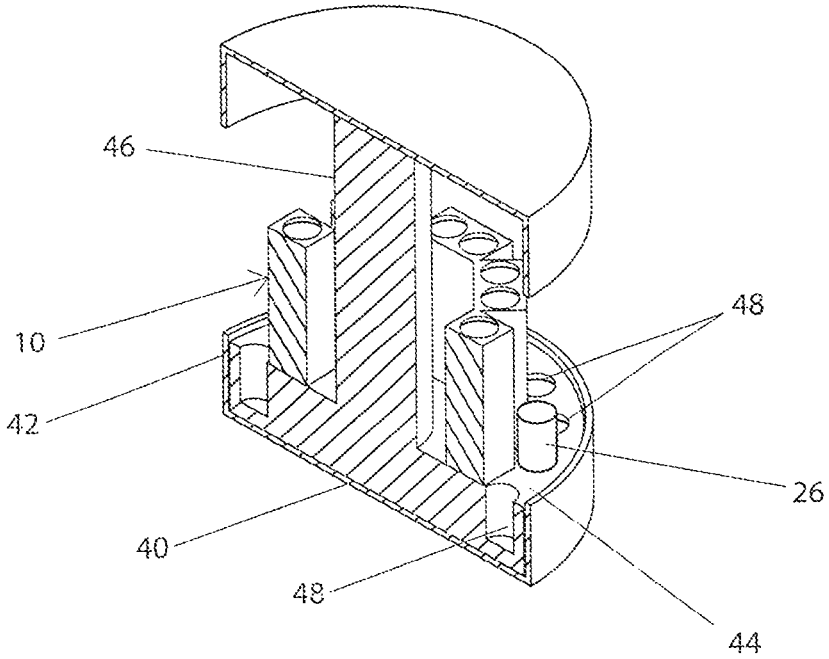
FIG. 6 is a partial perspective view of the variable weight toning strap storage unit.

Referring next to FIGS. 5 and 6, details of a variable weight toning strap storage unit will be described. The storage unit 30 may be in the form of a cylinder having a base 32 and removable portion 34. The removable portion includes a generally flat top 36 and circular side walls 38. The storage unit base 32 may also include a flat bottom 40 and upwardly extending side wails 42. The base 32 and removable portion 34 are interfitted such as by a friction fit or a twist fit to remain secured together as desired.

The storage unit 30 includes a first generally circular ledge or shoulder 44 spaced above the base 32. A circular rod 46 extends upwardly either from the base 32 through the ledge 44 or upwardly from the ledge 44. The ledge includes a series of vertical apertures 48 about its periphery. The apertures are configured in size and shape to receive and frictionally retain the bars. The two ends of the strap may be engaged, or alternatively the strap may just be formed as a circle and, in either situation, the strap is placed around the rod 46. The vertical apertures are spaced sufficiently far, radially, from the rod, such that the rod and surrounding strap do not interfere with the use of the apertures 48.

The storage unit may be of sufficient height such that two straps may be positioned vertically while surrounding the rod thus a pair of straps may be stored in a single storage unit. The removable portion 34 of the storage unit 30 allows access to remove or store straps and remove or store bars 26.

The strap and bars may be sold with or without a storage unit. Replacement straps may be sold independently of any other component; replacement bars and/or bars of increased weight may be sold independently of any other component.

The foregoing is a complete description of the variable weight toning strap and kit. Various modifications and variations have been described. Numerous other variations and modifications will be apparent to those of ordinary skill in the art. The variable weight toning strap and kit should be limited only by the scope of the following claims.

What is claimed is:

1. A variable weight toning system comprising:

a flexible member having first and second ends;

said flexible member being elongated in a first direction;

a buckle at the first end of said flexible member;

a tab at the second end of said flexible member, said tab having at least two apertures each of which can be separately engaged with said buckle;

said flexible member having opposed first and second elongated surfaces;

at least three generally rectangular sections positioned on one of said elongated surfaces;

each of said rectangular sections being elongated in a second direction perpendicular to said first direction;

said rectangular sections being spaced apart in said first direction;

said flexible member also being flexible between adjacent rectangular sections;

each of said rectangular sections including at least two sockets spaced apart in said first direction and elongated in said second direction; and at least one elongated bar configured to be removably frictionally received and retained in one of said sockets, a storage unit for removably receiving said elongated flexible member and for separately removably receiving a plurality of bars, said storage unit including a plurality of storage sockets, each storage socket being configured complementary to a configuration of one of the plurality of bars;

each of said plurality of bars being frictionally retained within one of said storage sockets in said storage unit;

said storage unit being of generally cylindrical configuration when viewed from above and having a first diameter; and the storage sockets in said storage unit being generally arranged as the circumference of a circle when viewed from above, said circle having a diameter less than said first diameter.

2. The variable weight toning system according to claim 1, wherein a length of the bar does not exceed an elongated length of one of said sockets.

3. The variable weight toning system according to claim 1, wherein at least one of said sockets is formed as an elongated hollow cylinder having first and second open ends.

4. The variable weight toning system according to claim 1, wherein each of said sockets is formed as an elongated hollow cylinder having first and second open ends.

5. The variable weight toning system according to claim 1, wherein said rectangular sections constitute the majority of a length of the flexible member.

6. The variable weight toning system according to claim 1, and further including at least three elongated bars each configured to be removably frictionally received and retained in said sockets.

7. The variable weight toning system according to claim 1, and further including at least two elongated bars in the sockets of one of said rectangular sections.

8. The variable weight toning system according to claim 1, including at least two bars each essentially of the same weight.

9. The variable weight toning system according to claim 1, including at least two tabs at the second end of said flexible member.

10. The variable weight toning system according to claim 1, wherein a length of a bar does not exceed an elongated length of one of said sockets.

11. The variable weight toning system according to claim 1, wherein a length of a bar exceeds a length of the storage socket.

12. The variable weight toning system according to claim 1 wherein each socket is circular in cross-section.

13. The variable weight toning system according to claim 1 wherein each storage socket is circular in cross-section.

* * * * *